United States Patent [19]

Freeman

[11] Patent Number: 5,074,014

[45] Date of Patent: Dec. 24, 1991

[54] TARP FASTENER

[75] Inventor: James W. Freeman, Portola, Calif.

[73] Assignee: Jerry Deidman, San Francisco, Calif.

[21] Appl. No.: 561,113

[22] Filed: Aug. 1, 1990

[51] Int. Cl.[5] ..... A41F 1/00

[52] U.S. Cl. ..... 24/714.6; 24/476; 24/519

[58] Field of Search ..... 24/714.6, 519, 459, 24/590, 464–480

[56] References Cited

U.S. PATENT DOCUMENTS

| | | | |
|---|---|---|---|
| 300,924 | 6/1884 | Walters | 24/519 |
| 554,742 | 2/1896 | Stimson | 24/519 |
| 585,781 | 7/1897 | Phelps | 24/519 |
| 595,032 | 12/1897 | Allen | 24/467 |
| 633,583 | 9/1899 | Gorton | 24/476 |
| 697,808 | 4/1902 | Chauvet | 24/459 |
| 730,534 | 6/1903 | Hawes | 24/473 |
| 738,474 | 9/1903 | Orewiler | 24/469 |
| 761,956 | 6/1904 | Gorton | 24/519 |
| 1,471,301 | 10/1923 | Winterhalder | 24/519 |
| 1,851,787 | 3/1932 | Vorwerk | 24/519 |
| 2,041,498 | 5/1936 | Swidersky | 24/459 |
| 2,089,869 | 8/1937 | Wratschko | 24/519 |
| 2,093,231 | 9/1937 | Broadwell | 24/464 |
| 2,745,163 | 5/1956 | van Buren, Jr. | 24/464 |
| 3,162,920 | 12/1964 | Durham | 24/265 |
| 4,688,304 | 8/1987 | Marcott | 24/519 |

FOREIGN PATENT DOCUMENTS

| | | | |
|---|---|---|---|
| 593905 | 9/1925 | France | 24/468 |

*Primary Examiner*—Victor N. Sakran

*Attorney, Agent, or Firm*—Limbach, Limbach & Sutton

[57] ABSTRACT

An improved tarp fastener is disclosed. The fastener comprises a button and a roughly hair-pin shaped wire retainer, the apical segment is bent out of the plane of the retainer so that the apical segment is spaced sufficiently apart from button to accommodate a variety of tarp thicknesses when the button and retainer are engaged and fastened to a tarp.

7 Claims, 1 Drawing Sheet

TARP FASTENER

FIELD OF THE INVENTION

This invention relates generally to fasteners and more particularly to button and loop type fasteners for securing tarps and other cloth or cloth-like materials.

BACKGROUND OF THE INVENTION

A variety means for fastening tarps and other cloth-like materials are known in the art. In the case of tarps, the cloth is provided with a plurality of holes along its margin through which rope or string can be threaded to secure the tarp in a desired position. Frequently, these holes in the fabric are reinforced with metallic or plastic eyes to prevent damage to the material. Unfortunately, the stresses necessary to secure the tarp in a taut position frequently lead to the ripping or fraying of the cloth.

In an attempt to avoid these problems, button and loop fasteners have been utilized, a variety of which are known in the art. See, for instance, U.S. Pat. Nos. 554,742; 585,781; 761,956; 2,089,869; and 4,688,304. Unfortunately, some such fasteners are incapable of handling cloth of widely varying thicknesses, particularly cloth that is thick or stiff. Additionally, known button and loop fasteners still result in a certain amount of stress-induced cloth injury because the cloth tends to become bunched up and deformed.

SUMMARY OF THE INVENTION

The foregoing and other problems associated with known fasteners for securing tarps are overcome by the present invention. According to the present invention, a fastener comprising a wire retainer and a button is provided. The wire retainer is roughly hair-pin shaped and is provided with two legs joined at the top of the hair-pin. The legs occupy a plane and are bent inward to form a crimp in the outline of the retainer so that the legs define a first region and a second region. The first region has a diameter sufficient to receive the button when surrounded by tarp material. The second region has a diameter less than that of the first region so that the button, once guided past the crimp, is securely received within the second region between the two legs. The hair-pin end of the retainer is further characterized by having a segment of the retainer, herein called a bridge, bent out of the plane defined by the legs sufficient to ensure that the bridge is spaced apart from the button when the button is received within the second region.

The fastener of the present invention is superior to existing fasteners in its unique configuration that results in it being able to affix securely in any location of the tarp. More importantly, the novel configuration of the bent bridge of the retainer allows more layers of a cloth tarp to be fastened than is possible with known fasteners, such as when a tarp is too large for a certain area.

It is therefore an object of the present invention to provide a tarp fastener that is capable of accommodating various tarp material thicknesses, or several thicknesses of tarp material.

Another object of the present invention is to provide a tarp fastener that is capable of gripping the material of the tarp without resulting in undue stress injury.

A further object of the present invention is to provide a tarp fastener that is easy and inexpensive to manufacture.

These and other objects will be more readily understood upon consideration of the following detailed description of embodiments of the invention and the drawings.

DETAILED DESCRIPTION OF THE INVENTION

Figure 1:
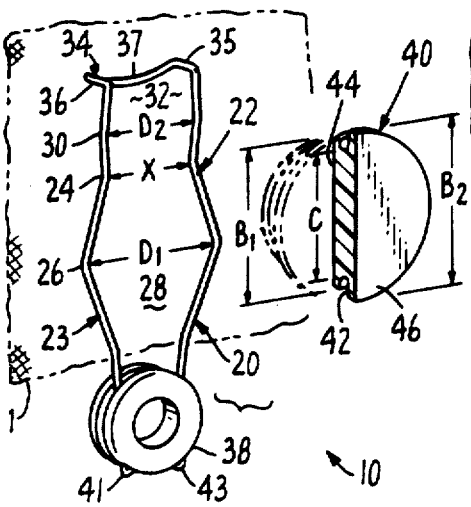
FIG. 1 is a view in perspective of the fastener of the present invention in disengaged position.

Turning first to FIG. 1, the fastener 10 of the present invention will now be described. The fastener 10 is comprised of a retainer 20 and a button 40. The retainer 20, as will be described in greater detail below, is configured to receive a button 40 when it is surrounded by a tarp or other desired material that is to be fastened down.

The retainer 20 is roughly hair-pin shaped in outline and is provided with a first leg 22 and a second leg 23. The legs together define and occupy a plane. The legs are joined at a first end of the retainer by an eye 38 having passages 39 through which the legs pass and at the hair-pin, or second, end of the retainer by a bridge 34. The passages 39 hold the legs against separation at the first end. Distal ends 41 and 43 on the legs 22 and 23, repsectively, are bent into abutting engagement with the eye 38 to prevent removal of the eye from the legs. The legs are bent inward to form a crimp 24 having a diameter of X. Moving away from the crimp toward the first end, the legs are bent outward to form a first bulge 26 which bounds a first region 28 and has a maximum diameter of D-1. Toward the second end, the legs are bent outward to form a second bulge 30 which bounds a second region 32 and has a maximum diameter of D-2.

Bridge 34 comprises a first projecting segment 35 attached to first leg 22 and a second projecting segment 36 attached to second leg 23, with the projecting segments connected by a connecting segment 37. Projecting segments 35 and 36 are bent out of the plane occupied by legs 22 and 23 at an angle sufficient to displace the connecting segment above the plane occupied by the legs. The length of projecting segments 35 and 36, along with the angle of their divergence from legs 22 and 23 will be determined by the width of button 40, more particularly by that portion of the width that projects above the leg defined plane when the button is engaged with the retainer. It is preferred to position connecting segment 37 so that there is a separation between the connecting segment and the button sufficient to accommodate the thickness of the tarp to be fastened.

Retainer 20 may be fabricated from any suitable material that is flexible but which returns substantially to its original configuration after being deformed and which is not brittle. Metal wire of a gauge sufficient to maintain its shape after repeated fastenings and under stresses necessary to secure the tarp is preferred. Eye 38 may be fabricated from any durable material, although polymer plastic is preferred since it is inexpensive and easy to work.

Button 40 is disc shaped and is provided with a circumferential groove 42 which defines a first face 44 and a second face 46. The dimensions of button 40 are determined by the dimensions of retainer 20. As described above, crimp 24 has a minimum diameter of X; first bulge 26 has a maximum diameter of D-1; and second bulge 30 has a maximum diameter of D-2. Where first face 44 of button 40 has a maximum diameter of B-1, second face 46 has a maximum diameter of B2, and the button in the plane defined by groove 42 has a maximum diameter of C, the following are preferred mathematical relationships between the dimensions of button 40 and retainer 20:

1. $C<B1<B2$;
2. $X<D2<D1$;
3. C is substantially equal to D2 but is greater than X;
4. $D2<B1<D1$;
5. $B2>D1$.

Button 40 may be fabricated out of any durable material. As with eye 38, polymer plastic is preferred because it is easy to mold and inexpensive.

Figure 3:
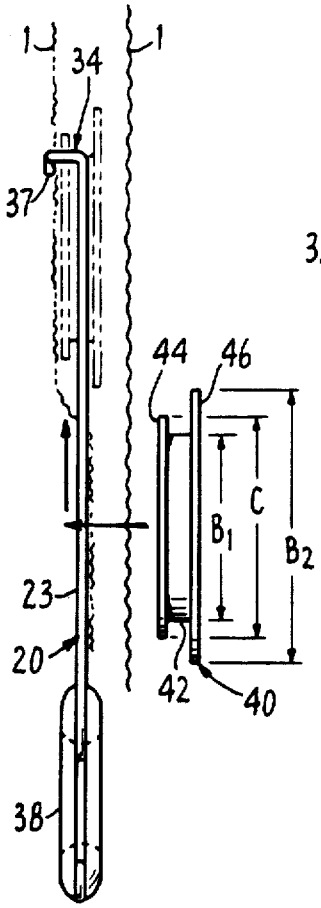
FIG. 3 is a view in cross section of the fastener of the present invention, with solid lines showing the disengaged position and phantom lines showing the first engaged embodiment.

Turning now to FIG. 3, a first embodiment of the engagement of button 40 with retainer 20 to secure a tarp will now be described. The edge of a tarp 1 or other material is positioned between button 40 and retainer 20, or simply gathered around first face 44 of button 40. The retainer is positioned so that protruding bridge 34 is opposite button 40 relative to the plane defined by legs 22 and 23. To assemble the fastener and secure the tarp, tarp 1 is pushed forward into first region 26 using first face 44 of button 40 until the edge of second face 46 is stopped by legs 22 and 23. Once the forward movement of button 40 is stopped, the button is pushed upward along the legs so that the legs are received by circumferential groove 42. The button is then slid past crimp 24 into second region 32 at which point the button is engaged with the retainer attaching the fastener to the tarp. Once fastened, the tarp may then be secured as desired by threading one end of a rope, string or other attachment means through eye 38 and securing the other end of the attachment means to a desired position. It should be noted that although the tarp is gripped between the button and the retainer, the cloth is free at the point of the bridge. Thus, less stress is placed on the cloth when fastened, and greater thicknesses of cloth can be accommodated relative to known fasteners.

Figure 2:
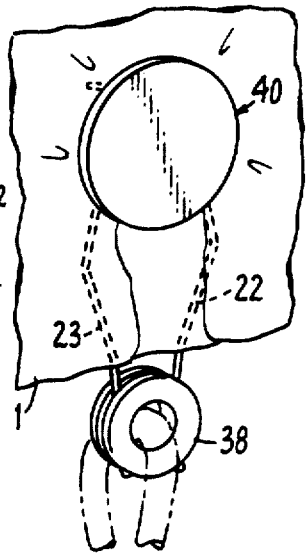
FIG. 2 is a view in perspective of a first engaged embodiment of the fastener of the present invention.
Figure 5:
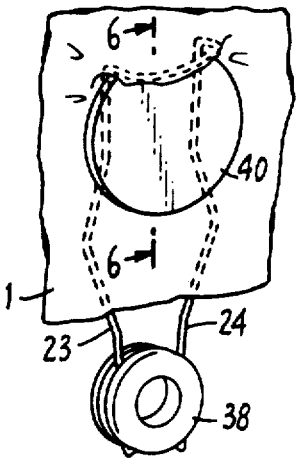
FIG. 5 is a view in perspective of a second engaged embodiment of the fastener of the present invention fastened in engaged position.
Figure 4:
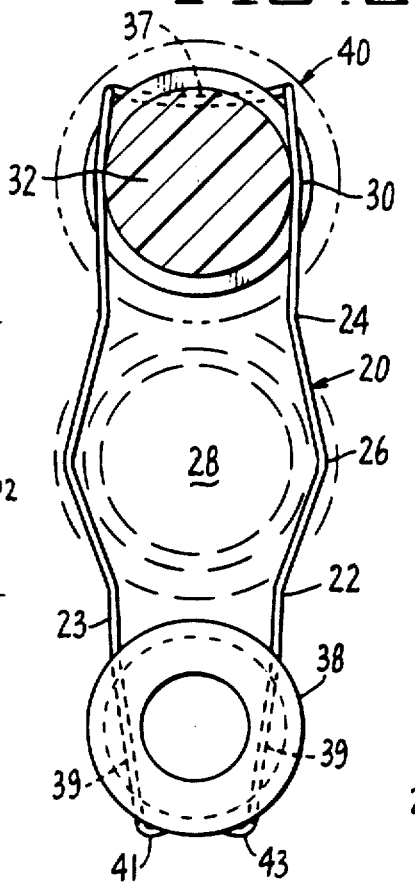
FIG. 4 is a plan view of the fastener of the present invention in the first engaged embodiment.
Figure 6:
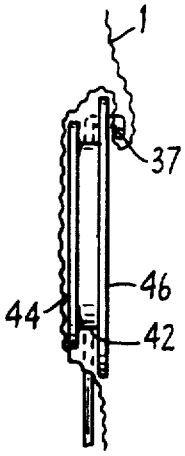
FIG. 6 is a view in cross section of the fastener taken on line 6—6 of FIG. 5.
Figure 7:
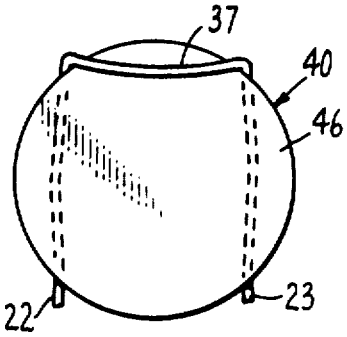
FIG. 7 is a plan view of a portion of the second engaged embodiment of the fastener of the present invention.

FIGS. 5–7 illustrate an alternative embodiment of engaging the fastener to a tarp. In this embodiment, retainer 20 is positioned so that bridge 34 is on the same side of retainer 20 as button 40 relative to the plane defined by legs 22 and 23. As in the embodiment illustrated in FIG. 3, the tarp is gathered around first face 44 of button 40 followed by insertion of the button and tarp into first region 28. Button 40 is then slid upwards and into place in second region 32 as described above. The configuration of the tarp relative to the fastener when button 40 is engaged with retainer 20 in this way is shown in FIG. 5. Unlike the first embodiment where the material of the tarp passes freely through a gap between button 40 and bridge 34 of retainer 20, the cloth is folded into an s-shaped configuration relative to the lip of second face 46 and bridge 34, as shown in cross-section in FIG. 6. This engagement embodiment appears to provide extra grip relative to the engagement embodiment shown in FIGS. 2–4, but may limit the range of thicknesses of tarp material that the fastener is able to accommodate.

It is now apparent that the fastener of the present invention shows marked improvements over known fasteners. It is to be understood however that although certain preferred embodiments have been disclosed and described above, other embodiments are possible without departing from that which is the invention described herein. It is intended therefore that the invention be defined by the claims that follow as well as equivalents thereof.

I claim:

1. A tarp fastener comprising:

a disc-shaped button; and a roughly hairpin-shaped retainer having a first end and a second end, said retainer provided with a first leg and a second leg occupying a plane, the first and second legs bent toward each other within the plane to form a crimp defining a first region proximate to said first end for freely receiving said button when surrounded by tarp material and having a maximum diameter of D-1 and a second region proximate to said second end for securing said button within the retainer when said button is slid past the crimp from the first region and having a maximum diameter of D-2, said second end provided with a bridge having a first projecting segment connected to the first leg and a second projecting segment connected to the second leg and interconnected by a connecting segment, the bridge configured so that the connecting segment is positioned over and is spaced apart from the button.

2. The tarp fastener of claim 1 wherein said button is provided with a circumferential groove which receives retainer and guides movement of said button within said retainer.

3. The tarp fastener of claim 2 wherein the circumferential groove defines a first face having a diameter less than D-1 but greater than D-2, and a second face having a diameter greater than D-2.

4. The tarp fastener of claim 3 further comprising attachment means for securing the tarp fastener in a desired position.

5. The tarp fastener of claim 1 further comprising means securing the first and second legs against separation at the first end of the retainer.

6. The tarp fastener of claim 5 wherein the means securing the first and second legs against separation comprises an eye having passages therein through which the first and second legs extend.

7. The tarp fastener of claim 6 wherein the first and second legs have distal ends secured in abutting engagement with the eye to prevent separation of the eye from the legs.

* * * * *